US010870301B2

(12) United States Patent
Ishida

(10) Patent No.: US 10,870,301 B2
(45) Date of Patent: Dec. 22, 2020

(54) COMBINATION OF THERMAL TRANSFER SHEET AND SEAL-TYPE PRINTING SHEET, AND THERMAL TRANSFER SHEET

(71) Applicant: Dai Nippon Printing Co., Ltd., Tokyo (JP)

(72) Inventor: Tadahiro Ishida, Tokyo (JP)

(73) Assignee: Dai Nippon Printing Co., Ltd., Tokyo (JP)

( * ) Notice: Subject to any disclaimer, the term of this patent is extended or adjusted under 35 U.S.C. 154(b) by 0 days.

(21) Appl. No.: 16/486,918

(22) PCT Filed: Mar. 1, 2018

(86) PCT No.: PCT/JP2018/007726
§ 371 (c)(1),
(2) Date: Aug. 19, 2019

(87) PCT Pub. No.: WO2018/159747
PCT Pub. Date: Sep. 7, 2018

(65) Prior Publication Data

US 2020/0230990 A1 Jul. 23, 2020

(30) Foreign Application Priority Data

Mar. 1, 2017 (JP) ..... 2017-038615

(51) Int. Cl.
*B41M 5/382* (2006.01)

(52) U.S. Cl.
CPC ..... *B41M 5/38228* (2013.01)

(58) Field of Classification Search
CPC ..... B41M 5/38228
See application file for complete search history.

(56) References Cited

U.S. PATENT DOCUMENTS 4,984,823 A 1/1991 Ishii et al.
5,712,673 A 1/1998 Hayashi et al.
5,741,583 A 4/1998 Yoshida

FOREIGN PATENT DOCUMENTS

JP H02-000890 A1 1/1990
JP H07-40668 A 2/1995
(Continued)

OTHER PUBLICATIONS

International Search Report and Written Opinion (Application No. PCT/JP2018/007726) dated Apr. 17, 2018.
(Continued)

*Primary Examiner* — Bradley W Thies
(74) *Attorney, Agent, or Firm* — Burr & Brown, PLLC

(57) ABSTRACT

Provided is a combination of a thermal transfer sheet and a seal-type printing sheet, the combination being capable of preventing occurrence of wrinkles in a print.
In a combination of a thermal transfer sheet including a substrate and a colorant layer provided on one surface of the substrate and a seal-type printing sheet including a releasing substrate and a printing paper sheet with a pressure-sensitive adhesive layer provided on a portion of one surface of the releasing substrate, the difference between the dynamic friction coefficient between the colorant layer in the thermal transfer sheet and the printing paper sheet with a pressure-sensitive adhesive layer in the seal-type printing sheet and the dynamic friction coefficient between the colorant layer in the thermal transfer sheet and the releasing substrate in the seal-type printing sheet is 1.0 or less.

3 Claims, 1 Drawing Sheet

(56) References Cited

FOREIGN PATENT DOCUMENTS

| | | | | | |
|---|---|---|---|---|---|
| JP | H07-061151 | A1 | | 3/1995 | |
| JP | H08-002115 | A1 | | 1/1996 | |
| JP | H08-183261 | A1 | | 7/1996 | |
| JP | H09-099644 | A1 | | 4/1997 | |
| JP | H10-251582 | A | | 9/1998 | |
| JP | H11-78256 | A1 | | 3/1999 | |
| JP | H11-115329 | A1 | | 4/1999 | |
| JP | H11-321133 | A1 | | 11/1999 | |
| JP | 2000-062324 | A1 | | 2/2000 | |
| JP | 2004-351638 | A1 | | 12/2004 | |
| JP | 2004351638 | A | * | 12/2004 | ..... B41M 5/392 |
| JP | 2006-043992 | A1 | | 2/2006 | |
| JP | 2011-062824 | A1 | | 3/2011 | |
| JP | 2014-069463 | A1 | | 4/2014 | |
| JP | 2015-030123 | A | | 2/2015 | |

OTHER PUBLICATIONS

Extended European Search Report (Application No. 18761674.3) dated May 26, 2020.
Korean Office Action (Application No. 10-2019-7022827) dated Oct. 19, 2020 (with English translation).

* cited by examiner

COMBINATION OF THERMAL TRANSFER SHEET AND SEAL-TYPE PRINTING SHEET, AND THERMAL TRANSFER SHEET

FIELD OF THE INVENTION

The present invention relates to a combination of a thermal transfer sheet and a seal-type printing sheet, and a thermal transfer sheet.

DESCRIPTION OF RELATED ART

There has conventionally been performed a thermal transfer type printing, in which a thermal transfer sheet and a transfer receiving article such as a printing paper sheet are superposed on each other, and colorants on the thermal transfer sheet are transferred onto the transfer receiving article.

An examples of the thermal transfer sheet is one described in Patent Literature 1. An example of the transfer receiving article to be used in combination with the thermal transfer sheet like this is a seal-type printing sheet including a releasing substrate and a printing paper sheet with a pressure-sensitive adhesive layer provided on one surface of the releasing substrate.

CITATION LIST

Patent Literature

Patent Literature 1: Japanese Patent Laid-Open No. 11-115329

SUMMARY OF THE INVENTION

Technical Problem

The inventors have found that, when printing is made using a thermal transfer sheet and using a seal-type printing sheet as a transfer receiving article, particularly when printing is made using a seal-type printing sheet in which a printing paper sheet with a pressure-sensitive adhesive layer is provided not on the entire surface of, but only on a portion of a releasing substrate and the releasing substrate is partially exposed, wrinkles may occur in the print and printing failures may occur.

The present invention has been made under such situations, and it is a major object thereof to provide a combination of a thermal transfer sheet and a seal-type printing sheet, the combination being capable of preventing occurrence of wrinkles in a print, and a thermal transfer sheet capable of preventing occurrence of wrinkles in a print even when used with a seal-type printing sheet including a releasing substrate partially exposed.

Solution to Problem

An embodiment of the present invention for solving the above problems is a combination of: a thermal transfer sheet including a substrate and a colorant layer provided on one surface of the substrate; and a seal-type printing sheet including a releasing substrate and a printing paper sheet with a pressure-sensitive adhesive layer provided on a portion of one surface of the releasing substrate, wherein the difference between the dynamic friction coefficient between the colorant layer in the thermal transfer sheet and the printing paper sheet with a pressure-sensitive adhesive layer in the seal-type printing sheet and the dynamic friction coefficient between the colorant layer in the thermal transfer sheet and the releasing substrate in the seal-type printing sheet is 1.0 or less.

In the embodiment of the present invention, an organic filler may be contained in the colorant layer in the thermal transfer sheet at a content of 2% by mass or more and 6% by mass or less based on the total mass of the colorant layer.

In the embodiment of the present invention, the organic filler may have an average particle size of 1.0 μm or more and 2.5 μm or less.

Another embodiment of the present invention for solving the above problems is a thermal transfer sheet including a substrate and a colorant layer provided on one surface of the substrate, wherein an organic filler is contained in the colorant layer at a content of 2% by mass or more and 6% by mass or less based on the total mass of the colorant layer.

In the another embodiment of the present invention, the organic filler may have an average particle size of 1.0 μm or more and 2.5 μm or less.

Advantageous Effects of Invention

According to a combination of a thermal transfer sheet and a seal-type printing sheet of the present invention, in which the difference between the dynamic friction coefficient between a colorant layer in the thermal transfer sheet and a printing paper sheet with a pressure-sensitive adhesive layer in the seal-type printing sheet and the dynamic friction coefficient between the colorant layer in the thermal transfer sheet and a releasing substrate in the seal-type printing sheet is 1.0 or less, it is possible to uniformize the friction between the thermal transfer sheet and the seal-type printing sheet on printing and, as a result, it is possible to achieve satisfactory printing while preventing occurrence of wrinkles in the print.

A thermal transfer sheet of the present invention can achieve satisfactory printing while preventing occurrence of wrinkles in a print, when used in combination with a commercially available seal-type printing sheet.

DETAILED DESCRIPTION OF THE INVENTION

Figure 1:
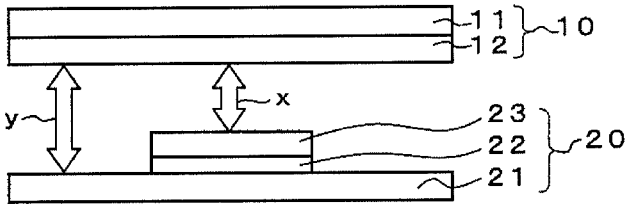
FIG. 1 is a schematic sectional view of a combination of a thermal transfer sheet and a seal-type printing sheet according to an embodiment of the present invention.

Hereinbelow, a combination of a thermal transfer sheet and a seal-type printing sheet according to an embodiment of the present invention (hereinbelow, it may be simply referred to as a combination) will be described with reference to the drawings. In the drawings, for the sake of illustration and easier understanding, scales, horizontal to vertical dimensional ratios and the like may be exaggeratingly modified from those of the real things.

(Combination of Thermal Transfer Sheet and Seal-Type Printing Sheet)

FIG. 1 is a schematic sectional view of a combination of a thermal transfer sheet and a seal-type printing sheet according to an embodiment of the present invention.

As shown in FIG. 1, a thermal transfer sheet 10 according to the combination of the present embodiment includes a substrate 11 and a colorant layer 12 provided on one surface of the substrate 11 (the lower surface in FIG. 1).

Meanwhile, a seal-type printing sheet 20 according to the combination of the present embodiment includes a releasing substrate 21 and a printing paper sheet 23 with a pressure-sensitive adhesive layer 22 provided on a portion of one surface of the releasing substrate 21 (the upper surface in FIG. 1). As shown in FIG. 1, the printing paper sheet 23 with a pressure-sensitive adhesive layer 22 is provided only on a portion of one surface of the releasing substrate 21, and thus, there is a portion at which the releasing substrate 21 is exposed on the surface on the side where the printing paper sheet 23 with a pressure-sensitive adhesive layer 22 is provided.

The combination like this of the present embodiment is characterized in that the difference between the dynamic friction coefficient μP(x) between the colorant layer 12 in the thermal transfer sheet 10 and the printing paper sheet 23 with a pressure-sensitive adhesive layer 22 in the seal-type printing sheet 20, that is, the dynamic friction coefficient μP(x) in the portion of an arrow x shown in FIG. 1 and the dynamic friction coefficient μP(y) between the colorant layer 12 in the thermal transfer sheet 10 and the releasing substrate 21 in the seal-type printing sheet 20, that is, the dynamic friction coefficient μP(y) in the portion of an arrow y shown in FIG. 1 is 1.0 or less.

In the case where printing is made by using the thermal transfer sheet 10 and the seal-type printing sheet 20, printing and conveyance are made while the colorant layer 12 of the thermal transfer sheet 10 is in contact with the printing paper sheet 23 of the seal-type printing sheet 20 as a portion to be printed and simultaneously in contact with the releasing substrate 21 of the seal-type printing sheet 20 as a portion not to be printed, inside a printer. In this case, the dynamic friction coefficient μP(x) between the colorant layer 12 of the thermal transfer sheet 10 and the printing paper sheet 23 of the seal-type printing sheet 20 and the dynamic friction coefficient μP(y) between the colorant layer 12 of the thermal transfer sheet 10 and the releasing substrate 21 of the seal-type printing sheet 20 have not been considered at all in a conventional combination, and thus, there may be a significant difference between these two dynamic friction coefficients. Then, in the case where printing is made by superposing the thermal transfer sheet 10 on the seal-type printing sheet 20, a portion has an extremely larger dynamic friction coefficient than that of another portion, and thus, there occurs a phenomenon where the portion is unlikely to slip and becomes caught. In contrast, a portion has an extremely smaller dynamic friction coefficient than that of another portion, and there occurs a phenomenon where the portion extremely slips. These phenomena may lead to occurrence of wrinkles of a printing paper sheet inside a printer, resulting in printing defects. However, according to the combination of the present embodiment, as mentioned above, the difference between the dynamic friction coefficient μP(x) between the colorant layer 12 in the thermal transfer sheet 10 and the printing paper sheet 23 with a pressure-sensitive adhesive layer 22 in the seal-type printing sheet 20 and the dynamic friction coefficient μP(y) between the colorant layer 12 in the thermal transfer sheet 10 and the releasing substrate 21 in the seal-type printing sheet 20 is 1.0 or less. Thus, it is possible to uniformize the dynamic friction coefficient in the entire thermal transfer sheet 10 and the entire seal-type printing sheet 20 and to prevent occurrence of wrinkles in a print due to a significant difference between dynamic friction coefficients, which depending on locations. Accordingly, satisfactory printing is enabled.

In order to achieve the combination like this of the present embodiment, it is necessary to measure dynamic friction coefficients at two points: the dynamic friction coefficient μP(x) between the colorant layer 12 of the thermal transfer sheet 10 and the printing paper sheet 23 of the seal-type printing sheet 20 and the dynamic friction coefficient μP(y) between the colorant layer 12 of the thermal transfer sheet 10 and the releasing substrate 21 of the seal-type printing sheet 20, and the measuring method therefor is as follows.

That is, in order to measure the dynamic friction coefficient μP(x) between the colorant layer 12 of the thermal transfer sheet 10 and the printing paper sheet 23 of the seal-type printing sheet 20, by use of a TENSILON® RTM500 (ORIENTEC CORPORATION) as a measuring apparatus, the printing paper sheet 23 of the seal-type printing sheet 20 is fixed on the stage while a specimen of the thermal transfer sheet 10 is adjusted to have an area of 50 mm×50 mm. The specimen is superposed on the printing paper sheet 23 of the seal-type printing sheet 20 fixed on the stage such that the colorant layer 12 of the thermal transfer sheet 10 is opposed to the printing paper sheet 23 of the seal-type printing sheet 20, and a tensile test is performed under a load of 220 g and at a tensile rate of 100 mm/min. Then, dividing the tensile strength measurement value obtained in the tensile test by the load (220 g) can provide the dynamic friction coefficient μP(x). In order to measure the dynamic friction coefficient μP(y) between the colorant layer 12 of the thermal transfer sheet 10 and the releasing substrate 21 of the seal-type printing sheet 20, a tensile test is performed under the same conditions as in the case of measuring the dynamic friction coefficient μP(x) except that the releasing substrate 21 of the seal-type printing sheet 20 is fixed on the stage and superposition is made such that the colorant layer 12 of the thermal transfer sheet 10 is opposed to the releasing substrate 21 of the seal-type printing sheet 20.

When the difference between the dynamic friction coefficients (μP(x), μP(y)) measured by the above measuring method is 1.0 or less, it is possible to exert the acting effect described above. This difference is preferable as small as possible. The difference is more preferably 0.8 or less, particularly preferably 0.6 or less.

In the combination of the present embodiment, the difference between the dynamic friction coefficient μP(x) between the colorant layer 12 of the thermal transfer sheet 10 and the printing paper sheet 23 of the seal-type printing sheet 20 and the dynamic friction coefficient μP(y) between the colorant layer 12 of the thermal transfer sheet 10 and the releasing substrate 21 of the seal-type printing sheet 20 is only required to be 1.0 or less. Each value of the dynamic friction coefficients (μP(x), μP(y)) per se is not particularly limited, and a method of making the difference between the dynamic friction coefficients (μP(x), μP(y)) 1.0 or less is also not limited. Thus, a measure may be taken on the side of the thermal transfer sheet 10, for example, a measure may be taken on the side of the seal-type printing sheet 20, in contrast, or measures may be taken on both the sides.

Hereinbelow, the thermal transfer sheet 10 and the seal-type printing sheet 20 according to the combination of the present embodiment will be described using the drawings.

(Thermal Transfer Sheet)

Figure 2:
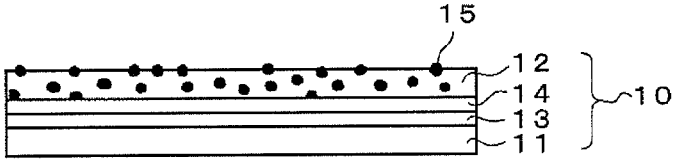
FIG. 2 is a schematic sectional view of the thermal transfer sheet according to the embodiment of the present invention.

FIG. 2 is a schematic sectional view of the thermal transfer sheet according to the embodiment of the present invention.

A thermal transfer sheet 10 shown in FIG. 2 has a structure in which a substrate 11, a peel layer 13, a protective layer 14, and a colorant layer 12 are layered in the order mentioned. The thermal transfer sheet 10 shown in FIG. 1 or FIG. 2 is an example and is not limited to these structures.

Substrate

The substrate 11 constituting the thermal transfer sheet 10 is not particularly limited, and a conventionally known substrate may be selected appropriately and used as long as the substrate has heat resistance and mechanical properties so as to be handled without a hitch. As the substrate 11 like this, various plastic films or sheets of: polyesters such as polyethylene terephthalate and polyethylene naphthalate, polyarylate, polycarbonate, polyurethane, polyimide, polyetherimide, cellulose derivatives, polyethylene, ethylene-vinyl acetate copolymers, polypropylene, polystyrene, acryl, polyvinyl chloride, polyvinylidene chloride, polyvinyl alcohol, polyvinyl butyral, nylon, polyether ether ketone, polysulfone, polyethersulfone, tetrafluoroethylene-perfluoroalkyl vinyl ether copolymers, polyvinyl fluorides, tetrafluoroethylene-ethylene copolymers, tetrafluoroethylene-hexafluoropropylene copolymers, polychlorotrifluoroethylene, polyvinylidene fluoride, and the like can be enumerated. These materials each may be used singly or may be used as a layered structure thereof in combination with another material. The thickness of the substrate 11 may be appropriately set depending on the type of the material, so that the strength and heat resistance of the substrate become appropriate. The thickness is generally about 2.5 μm or more and 100 μm or less.

The substrate 11 may be subjected to an adhesive treatment on the surface where a peel layer 13 that will be mentioned later is to be formed. Applying the adhesive treatment enables the adhesion between the substrate 11 and the peel layer 13 to be improved. As the adhesive treatment, a known surface modification technique for resin surfaces such as corona discharge treatment, flame treatment, ozone treatment, ultraviolet treatment, radiation treatment, roughening treatment, chemical treatment, plasma treatment, low temperature plasma treatment, primer treatment, grafting treatment, and the like may be applied as it is. Alternatively, two or more of these treatments may be used in combination.

Peel Layer

The thermal transfer sheet 10 may have the peel layer 13. This peel layer 13 is an optional layer and is not necessarily an essential layer. Thus, a release layer, not shown, may be provided instead of the peel layer 13.

A material for forming the peel layer 13 is not particularly limited, and one can be appropriately selected from conventionally known materials used in the thermal transfer sheet 10 and used. For example, waxes, silicone wax, silicone resins, modified silicone resins, fluorine resins, modified fluorine resins, polyvinyl alcohol, acryl resins, thermal-crosslinking epoxy-amino resins, thermal-crosslinking alkyd-amino resins, and the like can be enumerated. One of these resins may be used singly, or two or more of these may be used in combination.

The thickness of the peel layer 13 is also not particularly limited, and is generally in the range of 0.5 μm or more and 5 μm or less.

Protective Layer

The thermal transfer sheet 10 may have a protective layer 14. This protective layer 14 is also an optional layer, similarly to the peel layer 13, and is not necessarily an essential layer.

A material for forming the protective layer 14 is not particularly limited, and one can be appropriately selected from conventionally known materials used in the thermal transfer sheet 10 and used. For example, ultraviolet absorber copolymers, acrylic resins, polyester type resins, polycarbonate type resins, polyurethane type resins, polyester type resins, polyamide type resins, epoxy type resins, phenol type resins, polyvinyl chloride type resins, polyvinyl acetate type resins, vinyl chloride-vinyl acetate copolymers, acid-modified polyolefin type resins, copolymers of ethylene with vinyl acetate, acrylic acid or the like, (meth)acryl type resins, polyvinyl alcohol type resins, polyvinyl acetal resins, polybutadiene type resins, rubber type compounds, and the like can be enumerated. One of these resins may be used singly, or two or more of these may be used in combination. A filler such as micro-silica and polyethylene wax also may be used in combination.

The thickness of the protective layer 14 is also not particularly limited, and is generally in the range of 0.5 μm or more and 5 μm or less.

Colorant Layer

The thermal transfer sheet 10 has the colorant layer 12. This colorant layer 12 is an essential layer in the thermal transfer sheet 10.

The colorant layer 12 may be a so-called thermal fusion type colorant layer or a sublimable type colorant layer. In either case, the colorant layer 12 is preferably designed in consideration of the dynamic friction coefficient μP(x) between the layer 12 and the printing paper sheet 23 of the seal-type printing sheet 20, the sheet 20 being used in combination with the thermal transfer sheet 10, and the dynamic friction coefficient μP(y) between the layer 12 and the releasing substrate 21 of the seal-type printing sheet 20.

For example, allowing an organic filler 15 to be contained in the colorant layer 12 causes the organic filler 15 to protrude on the surface of the colorant layer 12. By lowering the dynamic friction coefficient μP(x) between the layer 12 and the printing paper sheet 23 of the seal-type printing sheet 20 and the dynamic friction coefficient μP(y) between the layer 12 and the releasing substrate 21 of the seal-type printing sheet 20 by this protrusion, the difference between the dynamic friction coefficients (μP(x), μP(y)) may be 1.0 or less. The organic filler 15 is compatible with and mixes well with a binder resin constituting the colorant layer 12. The filler 15 is also preferable in respect of not adversely affecting the fixability of colors after printing.

As the organic filler 15 like this, acrylic fillers, polyamide type fillers, fluorine type fillers, melamine type fillers, polyethylene wax, and the like can be enumerated. Of these, melamine type fillers are particularly preferable.

The content of the organic filler 15 is not particularly limited and only required to be appropriately adjusted such that the acting effect described above, that is, the difference between the dynamic friction coefficients (μP(x), μP(y)) of 1.0 can be achieved. For example, the organic filler 15 is contained, for example, preferably at a content of 2% by mass or more 6% by mass or less, particularly preferably at a content of 2.5% by mass or more 5% by mass or less, based on the total mass of the colorant layer 12. Allowing the filler 15 to be contained in this content enables the acting effect described above to be fully exerted.

The average particle size of the organic filler 15 is not particularly limited, and the lower limit value thereof is 0.7

μm or more, particularly preferably 1.0 μm or more. The upper limit value thereof is preferably 2.5 m or less. Setting the lower limit value of the average particle size of the organic filler 15 at 0.7 μm or more can prevent occurrence of wrinkles on printing. Setting the upper limit value of the average particle size of the organic filler 15 at 2.5 μm or less can prevent occurrence of thinning on printing. The average particle size of the organic filler 15 can be determined by a method of measuring the size of primary particles directly from an electron micrograph of a vertical cross section of the thermal transfer sheet. Specifically, the minor axis diameter and the major axis diameter of a primary particle were measured, and the average thereof was taken as the particle size of the particle. Then, the particle size of 100 particles were measured in the same manner, and the average thereof was taken as their average particle size. The same result can be obtained by using either of a transmission electron microscope (TEM) or a scanning electron microscope (SEM).

As other components constituting the colorant layer 12, various colorants such as pigments and dyes, a binder, a various additives such as release agent, and the like can be enumerated.

The colorants may be appropriately selected from known organic and inorganic pigments or dyes. For example, preferable are colorants having sufficient coloring density and undergoing no discoloration or fading due to light, heat, or the like. The colorants may be materials that develop a color by heating and materials that develop a color when coming in contact with components applied on the surface of the transfer receiving article. The colors of the colorants are not limited to cyan, magenta, yellow, and black, and colorants of various colors may be used. A thermally-fusible ink layer constituted by a black colorant can be preferably used because no gray scaling is required.

As a wax component to be used the binder, microcrystalline wax, carnauba wax, paraffin wax, and the like may be enumerated. Further, various waxes, such as Fischer-Tropsch wax, various low-molecular-weight polyethylenes, Japan wax, beeswax, spermaceti, insect wax, wool wax, shellac wax, candelilla wax, petrolatum, polyester wax, partially-modified wax, esters of fatty acid, and fatty acid amides can be enumerated.

As a resin component to be used as a binder, ethylene-vinyl acetate copolymers, ethylene-acrylic acid ester copolymers, polyester, polyethylene, polystyrene, polypropylene, polybutene, petroleum resin, vinyl chloride resins, vinyl chloride-vinyl acetate copolymers, polyvinyl alcohol, vinylidene chloride resins, acryl resins, methacryl resins, polyamides, polycarbonates, fluorine resins, polyvinyl formal, polyvinyl butyral, acetyl cellulose, nitro cellulose, polyvinyl acetate, polyisobutylene, ethyl cellulose, and polyacetal may be enumerated. Particularly, resin components conventionally used as heat-sensitive adhesives and having a relatively low softening point, for example, a softening point of 50° C. or more and 80° C. or less are preferable.

As various additives, in addition to the organic filler 15, for example, in order to impart satisfactory thermal conductivity and thermal fusion transferability to the colorant layer 12, a thermally-conductive material may be blended as an additive for the binder. As such additives, carbonaceous materials such as carbon black, metals and metal compounds such as aluminum, copper, tin oxide, molybdenum disulfide, and the like may be enumerated.

A method for forming the colorant layer 12 is also not particularly limited. For example, a coating liquid for colorant layer is prepared by adjusting blending of a solvent such as water and an organic solvent as required to the colorant and binder described above. The coating liquid is applied on one surface of the substrate 11 using a conventionally known coating device and dried to enable the colorant layer 12 to be formed. The coating device for the coating liquid for colorant layer is not particularly limited, and a gravure coater, roll coater, wire bar, screen printer, and the like can be enumerated. The same applies to coating devices for various coating liquids to be described below.

The thickness of the colorant layer can be appropriately set in the range where a required printing density and thermal sensitivity are balanced. The thickness is not particularly limited, and is preferably in the range of 0.1 μm or more and 30 μm or less, more preferably of the order of 0.3 μm or more and 20 μm or less.

When a material lacking resistance against high heat is used as the substrate 11, a back face layer, although not shown, is preferably provided on the surface of the substrate 11 on the side to be in contact with the thermal head, that is, on the surface opposite to the surface on which the colorant layer 12 of the substrate 11 is provided, in order to improve the slippability of the thermal head and prevent sticking. The back face layer includes, as base constituents, a resin having heat resistance and a material that serves as a thermal release agent or slip agent. Providing such a back face layer enables a colorant to be transferred without occurrence of sticking, even in a thermal transfer sheet including a plastic film vulnerable to heat, for example, as the substrate 11.

The back face layer can be formed by preferably using a binder resin to which a slip agent, a surfactant, inorganic particles, organic particles, a pigment, and the like are added. As the binder resin to be used in the back face layer, cellulosic resins, such as ethyl cellulose, hydroxyethyl cellulose, hydroxypropyl cellulose, methyl cellulose, cellulose acetate, cellulose acetate butyrate, and nitro cellulose, vinyl type resins, such as polyvinyl alcohol, polyvinyl acetate, polyvinyl acetal, polyvinyl pyrrolidone, acryl resins, polyacrylamide, and acrylonitrile-styrene copolymers, polyester resins, polyurethane resins, modified silicone or modified fluorine urethane resins, and the like may be enumerated.

Of these, it is preferable to use a crosslinked resin obtained by a reaction in which a binder resin having several reactive groups, for example, hydroxyl groups is used in combination with a polyisocyanate as a crosslinking agent. A device for forming the back face layer is not particularly limited. For example, a slip agent, a surfactant inorganic particles, organic particles, a pigment, and the like are added to a binder resin to prepare a material. This material is dissolved or dispersed in an appropriate solvent to prepare a coating liquid. Coating this liquid onto a surface opposite to the surface on which the colorant layer 12 of the substrate 11 is provided by using a conventionally known coating device and drying the liquid enables the back face layer to be formed.

The thickness of the back face layer is also not particularly limited. The thickness in the dried state is usually of the order of 0.01 μm or more and 10 μm or less.

(Seal-Type Printing Sheet)

Figure 3:
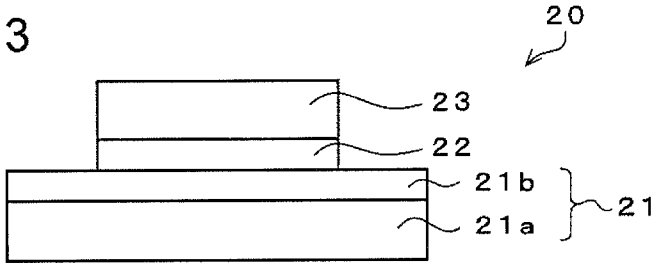
FIG. 3 is schematic sectional view of the seal-type printing sheet according to the combination of the embodiment of the present invention.

FIG. 3 is schematic sectional view of the seal-type printing sheet according to the combination of the embodiment of the present invention.

A seal-type printing sheet 20 shown in FIG. 3 includes a releasing substrate 21 and a printing paper sheet 23 with a pressure-sensitive adhesive layer 22 provided on a portion of one surface of the releasing substrate 21 (the upper surface in FIG. 3). As shown in FIG. 3, the printing paper sheet 23 with a pressure-sensitive adhesive layer 22 is provided only on a portion of one surface of the releasing substrate 21, and thus, there is a portion at which the releasing substrate 21 is exposed. The releasing substrate 21 may have a layered structure of a back face substrate 21*a* and a back face peel layer 21*b*.

Back Face Substrate

A material for the back face substrate 21*a* constituting the releasing substrate 21 is not particularly limited, and a conventionally known material can be appropriately selected and used. As the material for the back face substrate 21*a*, unstretched or stretched plastic films, for instance, polyesters having high heat resistance such as polyethylene terephthalate and polyethylene naphthalate, polypropylene, polycarbonate, cellulose acetate, polyethylene derivatives, polyamides, and polymethylpentene, wood-free paper, coated paper, art paper, cast coated paper, cardboard, emulsion-impregnated paper, synthetic rubber latex-impregnated paper, synthetic resin-filled paper, cellulose fiber paper, and the like can be enumerated.

The thickness of the back face substrate 21*a* constituting the releasing substrate 21 is not particularly limited, and is preferably 20 μm or more and 200 μm or less, for example. The thickness of the back face substrate 21*a* can be measured by use of resin embedding. Specifically, after an epoxy resin was used to embed a cut thermal transfer sheet (specimen), a section was formed in the thickness direction of the specimen by ultramicrotomy (cutting by a microtome and a diamond cutter). After this section was subjected to ion sputtering (Hitachi High-Technologies Corporation, E-1045, target: Pt, current: 15 mA, 10 seconds), a scanning electron microscope (Hitachi High-Technologies Corporation, A-4800TYPE I, accelerating voltage: 3.0 kV, emission current: 10 μA, working distance: 8 mm, detector: Mix) was used to obtain a cross-sectional image of the specimen. The thickness was measured on this image.

Back Face Peel Layer

As a resin for forming the back face peel layer 21*b* constituting the releasing substrate 21, waxes, silicone wax, silicone resins, modified silicone resins, fluorine resins, modified fluorine resins, polyvinyl alcohol, acryl resins, thermal-crosslinking epoxy-amino resins and thermal-crosslinking alkyd-amino resins, and the like may be enumerated. The back face peel layer 21*b* may be made of one resin or may be made of two or more resins. The back face peel layer 21*b* may be formed by adding a crosslinking agent such as an isocyanate compound and additives such as a tin type catalyst and an aluminum type catalyst to the resin as mentioned above.

The thickness of the back face peel layer 21*b* like this is generally of the order of 0.1 μm or more and 5 μm or less.

It is possible to impart releasability to the back face substrate 21*a* per se by allowing the back face substrate 21*a* to contain a release agent instead of providing the back face peel layer 21*b*. As the release agent in this case, solid waxes such as polyethylene wax, amide wax, and Teflon® powder, fluorine type or phosphoric ester type surfactants, silicone oils, various modified silicone oils such as reactive silicone oils and curable silicone oils, and various silicone resins, and the like can be enumerated.

Pressure-Sensitive Adhesive Layer

A material for the pressure-sensitive adhesive layer 22 constituting the seal-type printing sheet 20 is also not limited, and a conventionally known solvent type or aqueous pressure-sensitive adhesive can be used. Specifically, vinyl acetate resins, acryl resins, vinyl acetate-acryl copolymers, vinyl acetate-vinyl chloride copolymers, ethylene-vinyl acetate copolymers, ethylene-acrylic acid copolymers, ethylene-acryl acid ester copolymers, polyurethane resins, natural rubber, chloroprene rubber, nitrile rubber, and the like may be enumerated.

Printing Paper Sheet

A material for the printing paper sheet 23 constituting the seal-type printing sheet 20 is also not particularly limited, and conventionally known various materials can be used. Specifically, unstretched or stretched plastic films, for instance, polyesters having high heat resistance such as polyethylene terephthalate and polyethylene naphthalate, polypropylene, polycarbonate, cellulose acetate, polyethylene derivatives, polyamides, and polymethylpentene, wood-free paper, coated paper, art paper, cast coated paper, cardboard, and the like can be enumerated. The substrate may be one having a single-layer structure, or a composite film in which two or more layers of the materials exemplified above are layered also can be used.

Onto the printing face of the printing paper sheet 23, in order to improve the printability, corona surface treatment or plasma surface treatment may be applied, or an easy-adhesive layer including a vinyl acetate resin, acryl resin, vinyl acetate-acryl copolymer, vinyl acetate-vinyl chloride copolymer, ethylene-vinyl acetate copolymer, ethylene-acrylic acid copolymer, ethylene-acrylic acid ester copolymer, polyurethane resin, or the like may be provided. In order to provide the sheet with designability, a colorant or a metal and metal compound may be added to the material for the printing paper sheet 23, or the surface of the printing paper sheet 23 may be subjected to printing.

The structure of the seal-type printing sheet 20 described above is an example, and various function layers other than those described above may be layered.

EXAMPLES

Next, the present invention will be described more concretely with reference to examples and comparative examples. Hereinafter, unless otherwise specified, the expression of part(s) or % means that by mass.

Example 1

A 4.5-μm thick biaxially-oriented polyethylene terephthalate film (hereinafter, it is denoted as PET) (product name: Lumirror®, Toray Industries, Inc.) was used as a substrate. A coating liquid for back face layer having the following composition, as a back face layer, was applied onto one surface of the substrate by the gravure printing method and dried so as to obtain a thickness of 0.3 μm in the dried state to form a back face layer. Next, a coating liquid for peel layer having the following composition was applied onto the surface opposite to the back face layer of the substrate on which the back face layer had been formed by the gravure printing method and dried so as to obtain a thickness of 0.3 μm in the dried state to form a peel layer. Then, a coating liquid for protective layer having the following composition was applied onto the peel layer by the gravure printing method and dried so as to obtain a thickness of 0.5 μm in the dried state to form a protective layer. Subsequently, a coating liquid for colorant layer 1 having the following composition was applied onto the protective layer by the gravure printing method and dried so as to obtain a thickness of 0.7 μm in the dried state to form a thermal transfer sheet 1 according to Example 1.

<Coating Solution for Back Face Layer>

| | |
|---|---|
| Styrene - acrylonitrile copolymer | 11 parts |
| Linear saturated polyester type resin | 0.3 parts |
| Zinc stearyl phosphate | 6 parts |
| Melamine type filler | 3 parts |
| Methyl ethyl ketone | 80 parts |

<Coating Liquid for Peel Layer>

| | |
|---|---|
| Acrylic resin | 100 parts |
| Polyester resin | 2 parts |
| Polyethylene wax | 3 parts |
| Methyl ethyl ketone | 50 parts |
| Toluene | 50 parts |

<Coating Liquid for Colorant Layer 1>

| | |
|---|---|
| Carbon black | 50 parts |
| Polyester resin | 50 parts |
| Melamine type filler (average particle size: 1.2 μm) | 3 parts |
| Water | 10 parts |
| Isopropyl alcohol (IPA) | 30 parts |

As a seal-type printing sheet according to Example 1 for use in combination with the thermal transfer sheet 1 according to Examples 1 described above, a PET label (product name: 72825, Avery Dennison Japan) was provided. The PET label provided has a structure including a releasing substrate and a printing paper sheet with a pressure-sensitive adhesive layer provided on a portion of one surface of the releasing substrate.

Example 2

The same procedure as described in Example 1 was repeated, except for replacing the coating liquid for colorant layer 1 describe above, which was used for forming the thermal transfer sheet 1 according to Example 1, by a coating liquid for colorant layer 2 of the following composition, in order to prepare a combination of a thermal transfer sheet and a seal-type printing sheet according to Example 2.

<Coating Liquid for Colorant Layer 2>

| | |
|---|---|
| Carbon black | 50 parts |
| Polyester resin | 50 parts |
| Melamine type filler (average particle size: 1.2 μm) | 5 parts |
| Water | 10 parts |
| Isopropyl alcohol (IPA) | 30 parts |

Example 3

The same procedure as described in Example 1 was repeated, except for replacing the coating liquid for colorant layer 1 describe above, which was used for forming the thermal transfer sheet 1 according to Example 1, by a coating liquid for colorant layer 3 of the following composition, in order to prepare a combination of a thermal transfer sheet and a seal-type printing sheet according to Example 3.

<Coating Liquid for Colorant Layer 3>

| | |
|---|---|
| Carbon black | 50 parts |
| Polyester resin | 50 parts |

-continued

| | |
|---|---|
| Acrylic filler (average particle size: 0.8 μm) | 3 parts |
| Water | 10 parts |
| Isopropyl alcohol (IPA) | 30 parts |

Example 4

The same procedure as described in Example 1 was repeated, except for replacing the coating liquid for colorant layer 1 describe above, which was used for forming the thermal transfer sheet 1 according to Example 1, by a coating liquid for colorant layer 4 of the following composition, in order to prepare a combination of a thermal transfer sheet and a seal-type printing sheet according to Example 4.

<Coating Liquid for Colorant Layer 4>

| | |
|---|---|
| Carbon black | 50 parts |
| Polyester resin | 50 parts |
| Melamine type filler (average particle size: 3 μm) | 3 parts |
| Water | 10 parts |
| Isopropyl alcohol (IPA) | 30 parts |

Comparative Example 1

The same procedure as described in Example 1 was repeated, except for replacing the coating liquid for colorant layer 1, which was used for forming the thermal transfer sheet 1 according to Example 1, by a coating liquid for colorant layer A of the following composition, in order to prepare a combination of a thermal transfer sheet and a seal-type printing sheet according to Comparative Example 1.

<Coating Liquid for Colorant Layer A>

| | |
|---|---|
| Carbon black | 50 parts |
| Polyester resin | 50 parts |
| Water | 10 parts |
| Isopropyl alcohol (IPA) | 30 parts |

Comparative Example 2

The same procedure as described in Example 1 was repeated, except for replacing the coating liquid for colorant layer 1, which was used for forming the thermal transfer sheet 1 according to Example 1, by a coating liquid for colorant layer B of the following composition, in order to prepare a combination of a thermal transfer sheet and a seal-type printing sheet according to Comparative Example B.

<Coating Liquid for Colorant Layer B>

| | |
|---|---|
| Carbon black | 50 parts |
| Polyester resin | 50 parts |
| Melamine type filler (average particle size: 1.2 μm) | 1 part |
| Water | 10 parts |
| Isopropyl alcohol (IPA) | 30 parts |

Comparative Example 3

The same procedure as described in Example 1 was repeated, except for replacing the coating liquid for colorant layer 1, which was used for forming the thermal transfer sheet 1 according to Example 1, by a coating liquid for colorant layer C of the following composition, in order to prepare a combination of a thermal transfer sheet and a seal-type printing sheet according to Comparative Example 3.

<Coating Liquid for Colorant Layer C>

| | |
|---|---|
| Carbon black | 50 parts |
| Polyester resin | 50 parts |
| Melamine type filler (average particle size: 0.6 μm) | 3 parts |
| Water | 10 parts |
| Isopropyl alcohol (IPA) | 30 parts |

(Dynamic Friction Coefficient Measurement)

Calculation of Dynamic Friction Coefficient μP(x) Between Thermal Transfer Sheet and Printing Paper Sheet Portion of Seal-Type Printing Sheet A TENSILON® RTM500 (ORIENTEC CORPORATION) was used, and each printing paper sheet of the seal-type printing sheets of Examples 1 to 4 and Comparative Examples 1 to 3 was fixed on its stage. Meanwhile, each thermal transfer sheet was adjusted to have an area of 50 mm×50 mm as a specimen. The specimen of the thermal transfer sheet was superposed on the printing paper sheet of the seal-type printing sheet fixed on the stage such that the printing paper sheet of the seal-type printing sheet was opposed to the colorant layer of the thermal transfer sheet, and a tensile test was performed under a load of 220 g and at a tensile rate of 100 mm/min to measure the tensile strength. The dynamic friction coefficient μP(x) was calculated by dividing the value of the tensile strength measured by the load (220 g). The tensile strength was measured in an environment of 22.5° C. and 40% RH.

Calculation of Dynamic Friction Coefficient μP(y) Between Thermal Transfer Sheet and Releasing Substrate Portion of Seal-Type Printing Sheet The tensile strength was measured and the dynamic friction coefficient μP(y) was calculated in the same manner as for the test of the thermal transfer sheet and the printing paper sheet portion of the seal-type printing sheet, except that the releasing substrate of each seal-type printing sheet of Examples 1 to 4 and Comparative Examples 1 to 3 was fixed on the stage, and the specimen of each thermal transfer sheet was superposed on the releasing substrate of the seal-type printing sheet fixed on the stage such that the releasing substrate of the seal-type printing sheet was opposed to the colorant layer of the thermal transfer sheet. The tensile strength was measured in an environment of 22.5° C. and 40% RH.

(Printability Evaluation)

Each combination of a thermal transfer sheet and a seal-type printing sheet obtained in Examples 1 to 4 and Comparative Examples 1 to 3 was used. Each the colorant layer of the thermal transfer sheet was superposed on each the printing paper sheet side of the seal-type printing sheet, and printing was made consecutively on five combinations by using a label printer 14308 (Datamax-O'Neil) at a printing speed of 6 IPS and a printing energy of 20. Thereafter, the prints were visually evaluated based on the following evaluation criteria.

<Evaluation Criteria>

A: Printable without occurrence of wrinkles

B: Slight thinning occurred, but printable without occurrence of wrinkles

NG: Wrinkles occurred (Organic Solvent Resistance Evaluation)

A picket barcode was printed at a printing speed of 4 IPS and a printing energy of 26 by using each thermal transfer sheet obtained in Examples 1 to 4 and Comparative Examples 1 to 3 and using a label printer 14308 (Datamax-O'Neil). Thereafter, rubbing was made 100 times in a reciprocating manner under a load of 800 g by using a color fastness to rubbing tester, model FR-2S (Suga Test Instruments Co., Ltd.) and using a cotton cloth impregnated with 0.5 cc of isopropyl alcohol (IPA). Then, a barcode checker Quick Check 850 (Honeywell) was used to evaluate organic solvent resistance based on the following evaluation criteria. After all the evaluation results of the barcode checker before rubbing were confirmed to have evaluated as A, organic solvent resistance evaluation was performed.

<Evaluation Criteria>

A: Evaluation result by the barcode checker after rubbing is evaluated as A

B: Evaluation result by the barcode checker after rubbing is evaluated as B or C NG: Evaluation result by the barcode checker after rubbing is evaluated as D or lower The results of the printing evaluation and the organic solvent resistance evaluation are summarized in the following Table 1.

TABLE 1

| | | Example 1 | Example 2 | Example 3 | Example 4 | Comparative Example 1 | Comparative Example 2 | Comparative Example 3 |
|---|---|---|---|---|---|---|---|---|
| Dynamic friction coefficient | Thermal transfer sheet/printing paper sheet μP(x) | 0.51 | 0.47 | 0.5 | 0.48 | 0.66 | 0.48 | 0.48 |
| | Thermal transfer sheet/releasing substrate μP(y) | 1.27 | 1 | 1.4 | 0.95 | 2 or more | 2 or more | 2 or more |
| | Difference \|μP(x) − μP(y)\| | 0.76 | 0.53 | 0.9 | 0.47 | 1.34 or more | 1.52 or more | 1.52 or more |
| Printability | | A | A | A | B | NG | NG | NG |
| Organic solvent resistance | | A | B | A | B | A | A | A |

Also from the above results, it can be seen that the combinations of a thermal transfer sheet and a seal-type printing sheet according to Examples can prevent occurrence of wrinkles in a print.

REFERENCE SIGNS LIST

10 Thermal transfer sheet
11 Substrate
12 Colorant layer
13 Peel layer
14 Protective layer

15 Organic filler
20 Seal-type printing sheet
21 Releasing substrate
22 Pressure-sensitive adhesive layer
23 Printing paper sheet

The invention claimed is:

1. A combination of:

a thermal transfer sheet comprising a substrate and a colorant layer provided on one surface of the substrate; and a seal-type printing sheet comprising a releasing substrate and a printing paper sheet with a pressure-sensitive adhesive layer provided on a portion of one surface of the releasing substrate;

wherein a difference between a dynamic friction coefficient between the colorant layer in the thermal transfer sheet and the printing paper sheet with a pressure-sensitive adhesive layer in the seal-type printing sheet and a dynamic friction coefficient between the colorant layer in the thermal transfer sheet and the releasing substrate in the seal-type printing sheet is 1.0 or less.

2. The combination of a thermal transfer sheet and a seal-type printing sheet according to claim 1, wherein an organic filler is contained in the colorant layer in the thermal transfer sheet at a content of 2% by mass or more and 6% by mass or less based on the total mass of the colorant layer.

3. The combination of a thermal transfer sheet and a seal-type printing sheet according to claim 2, wherein the organic filler has an average particle size of 1.0 μm or more and 2.5 μm or less.

* * * * *